US008137254B2

(12) United States Patent
DeSmedt

(10) Patent No.: US 8,137,254 B2
(45) Date of Patent: Mar. 20, 2012

(54) METHOD OF MAKING BAG WITH INTERRUPTED SIDE GUSSETS

(75) Inventor: Eric DeSmedt, Crawfordsville, IN (US)

(73) Assignee: Hudson-Sharp Machine Co., Green Bay, WI (US)

( * ) Notice: Subject to any disclaimer, the term of this patent is extended or adjusted under 35 U.S.C. 154(b) by 352 days.

(21) Appl. No.: 12/311,848

(22) PCT Filed: Oct. 17, 2007

(86) PCT No.: PCT/US2007/022155

§ 371 (c)(1),
(2), (4) Date: Apr. 15, 2009

(87) PCT Pub. No.: WO2008/048640

PCT Pub. Date: Apr. 24, 2008

(65) Prior Publication Data

US 2010/0290722 A1 Nov. 18, 2010

Related U.S. Application Data

(60) Provisional application No. 60/852,196, filed on Oct. 17, 2006.

(51) Int. Cl.
*B31B 1/62* (2006.01)
*B65D 30/20* (2006.01)

(52) U.S. Cl. ..... 493/231; 493/243; 493/267; 383/120

(58) Field of Classification Search ..... 493/231, 493/232, 237, 243, 244, 267; 383/120, 167
See application file for complete search history.

(56) References Cited

U.S. PATENT DOCUMENTS

| | | | |
|---|---|---|---|
| 3,446,121 | A | 5/1969 | F. Achelpohl |
| 3,547,010 | A | 12/1970 | Gennerich et al. |
| 3,913,463 | A | 10/1975 | Hollis |
| 4,228,728 | A | 10/1980 | Hollis |
| 4,610,651 | A | 9/1986 | Jacobson et al. |

(Continued)

FOREIGN PATENT DOCUMENTS

| | | |
|---|---|---|
| DE | 10054395 | 8/2002 |

(Continued)

OTHER PUBLICATIONS

Supplementary European Search Report for correspondence application EP 07 83 9633 dated Aug. 4, 2010.

(Continued)

*Primary Examiner* — Hemant M Desai
(74) *Attorney, Agent, or Firm* — Wood, Phillips, Katz, Clark & Mortimer

(57) ABSTRACT

A method of forming a bag with at least one gusset on one side including the steps of (a) forming a bag blank having a front panel and a back panel connectable along opposite sides, (b) forming a gusset along one side of one of the front and back panels, the gusset comprising first and second gusset panels inwardly V-folded, which gusset panels have a removable gusset portion at a selected position on the one side, (c) adhesively adhering one side of a patch to one of the gusset panels to a location adjacent the removable gusset portion, the patch having a second adhesive on portions extending beyond the one gusset panel location to the removable gusset portion and beyond the V-fold, and (d) removing the removable gusset portion from the gusset.

8 Claims, 6 Drawing Sheets

U.S. PATENT DOCUMENTS

| | | | | |
|---|---|---|---|---|
| 4,840,611 | A * | 6/1989 | Van Erden et al. | 493/213 |
| 5,060,803 | A | 10/1991 | Beer et al. | |
| 5,364,189 | A | 11/1994 | Kuge et al. | |
| 6,261,000 | B1 | 7/2001 | Bois | |
| 6,425,847 | B1 | 7/2002 | Broenstrup | |
| 6,800,051 | B2 | 10/2004 | Koehn | |
| 7,192,191 | B2 | 3/2007 | Wedi et al. | |
| 7,506,487 | B2 | 3/2009 | Eads et al. | |
| 7,775,957 | B2 * | 8/2010 | Totani | 493/210 |
| 2001/0038721 | A1 * | 11/2001 | Bois | 383/64 |
| 2002/0103067 | A1 * | 8/2002 | Bois | 493/394 |
| 2002/0147090 | A1 | 10/2002 | Kuge et al. | |
| 2004/0208402 | A1 * | 10/2004 | Yeager | 383/120 |
| 2006/0062497 | A1 * | 3/2006 | Murray | 383/107 |
| 2007/0133908 | A1 | 6/2007 | Bruns | |
| 2007/0292053 | A1 | 12/2007 | Lin et al. | |
| 2008/0085823 | A1 | 4/2008 | Reggi | |
| 2008/0205801 | A1 * | 8/2008 | Alaux | 383/120 |

FOREIGN PATENT DOCUMENTS

| | | | |
|---|---|---|---|
| DE | 20 2004 006 856 | U1 | 10/2005 |
| DE | 10 2006 029 119 | A1 | 7/2007 |
| DE | 10 2006 029 893 | A1 | 7/2007 |
| EP | 0 834 454 | A1 | 4/1998 |
| EP | 1 754 596 | A1 | 2/2007 |
| EP | 1 777 167 | A1 | 4/2007 |
| EP | 1 795 335 | A2 | 6/2007 |
| GB | 2 263 662 | A | 8/1993 |
| JP | 8 034450 | A | 2/1996 |
| WO | 2006/067617 | A1 | 6/2006 |
| WO | 2008/028513 | A1 | 3/2008 |

OTHER PUBLICATIONS

International Search Report and Written Opinion for corresponding PCT application No. PCT/US07/22155 dated Feb. 25, 2008.

* cited by examiner

METHOD OF MAKING BAG WITH INTERRUPTED SIDE GUSSETS

CROSS REFERENCE TO RELATED APPLICATION(S)

This application claims priority in Provisional Application Ser. No. 60/852,196, filed Oct. 17, 2006, entitled "Bags with Reduced Size Gussets". The full disclosure of that application is hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to bottom sealed bags, and more particularly to side gusseted bottom seal bags.

BACKGROUND OF THE INVENTION

Technical Problems Posed by the Prior Art

There are, of course, many different types of bags used for many different applications. For example, bags are often used by individuals to carry their items. Such items may come in many different shapes and sizes, and bags are provided to accommodate such varying items. Further, bags are often used in a wide variety of manufacturing processes, including automatic filling processes.

Bags with gussets on the sides, for example, are provided to enable the bag to be stored flat with a width which is substantially less than half its opening perimeter. Moreover, gussets may be used to assist in defining the bag shape whereby, for example, the body of the bag may be opened to provide a carrying space with a circumference which is substantially greater than twice the width of the bottom of the bag. Bags with gussets on the sides are also often advantageously used in automatic filling processes However, while gussets may provide some advantages and meet specific objects at certain parts of the bag, they may also be less advantageous or even undesirable at other parts of the bag.

For example, interrupted gussets may be advantageously used in automatic filling processes, with such bags being easier to open, fill and seal/close after filling in such processes.

Further, interrupted gussets may be advantageous in other uses as well. That is, while gussets assist in providing maximum storage space in the bottom portion of the bag, they can be disadvantageous at the top opening of the bag where the gusseted shape may make it difficult to place items in the bag. A bag user may, for example, find the gusset to be difficult to position properly at the top opening where the gusset is most free to fold in or out. A gusset which is unintentionally folded into the top opening may snag on an item being placed in the bag. Further, a gusset along the bag may leave the top opening too big, allowing items contained in the bag to fall out too easily, or be readily taken without notice by thieves. Still further, while gussets when properly folded with the bag in a flat condition are advantageous in providing an easily storable shape, folding bags flat with the gussets in the proper position is often difficult and/or time consuming, particularly when handling many such bags. In fact, gussets in bags are often advantageous but, for varying reasons, may not be advantageous at every location along the bag.

However, particularly given the continuous nature of bag manufacturing materials, bags with gussets have been made most efficiently with gussets extending along the complete height of one or more sides of the bag. Manufacturing bags with interrupted gussets can be difficult and/or inefficient.

WO 2006/092517 A1 discloses a bag structure in which the gusset is stopped by cutting off the gusset panels from the open end of the bag to the position at which the gusset is desired to start, and then resealing the side edges of both sides of the bag where the gussets were removed. This structure limits the flexibility of the positioning of the gusset ends, and further may weaken the bag where the edges are resealed. The gusset ends are formed by cutting the gusset panels and folding them down. Folded gusset ends are also disclosed in WO 2005/105592 A1 and DE 20 2004 006 856 U1.

EP 0 834 454 A1 also discloses a bag with gusset-type sides which end before the top opening of the bag. This structure uses a single patch to close both open gussets, and requires special triangular transitions in which all four panels at that location must be each sealed together.

U.S. Pat. No. 6,261,000 B1 discloses a bag with gussets in which cutouts are formed in the gussets to discontinue them, with the edges of the cutouts heat sealed. However, it can be difficult to heat seal along those edges without risking heat sealing of adjacent areas which are not desired to be sealed.

The present invention is directed toward overcoming one or more of the problems set forth above.

SUMMARY OF THE INVENTION

The present invention relates to an advantageous method for manufacturing bags having gussets which are interrupted at one or more location along the side of the bag.

According to the present invention, the method of forming a bag with at least one gusset on one side includes the steps of (a) forming a bag blank having a front panel and a back panel connectable along opposite sides, (b) forming a gusset along one side of one of the front and back panels, the gusset comprising first and second gusset panels inwardly V-folded, which gusset panels have a removable gusset portion at a selected position on the one side, (c) adhesively adhering one side of a patch to one of the gusset panels to a location adjacent the removable gusset portion, the patch having a second adhesive on portions extending beyond the one gusset panel location to the removable gusset portion and beyond the V-fold, (d) removing the removable gusset portion from the gusset, and (e) adhering the second adhesive on the one side of the patch extending portions to facing portions of one of the front and back panel.

In a further form, the first and second patches are aligned on opposite sides of the bag.

In another form, the step of adhering the second adhesive comprises ultrasonic sealing.

In yet another form, the second adhesive is thermoadhesive on the one side of the patch, and the step of adhering the second adhesive comprises heating the patch while pressing the patch against the back panel.

In a still further form, the method further consists of (b1) forming a second gusset along the other side of one of the front and back panels, the second gusset comprising third and fourth gusset panels inwardly V-folded, which gusset panels have a removable second gusset portion at a selected position on the side, (c1) adhesively adhering one side of a second patch to one of the third and fourth gusset panels to a location adjacent the removable second gusset portion, the second patch having thermoadhesive on the one side and portions extending beyond the third and fourth gusset panel location to the removable second gusset portion and beyond the V-fold, (d1) removing the removable second gusset portion from the second gusset, and (e1) heating the second patch to adhere the one side of the second patch extending portions to facing portions of one of the front and back panel.

In another aspect of the present invention, a gusseted bag is provided including a front panel having opposite sides between an open end and a closed end, a back panel having opposite sides between an open end and a closed end and respectively connected to the front panel opposite sides, and a gusset connecting a part of one side of the front and back panels on one of the opposite sides. The gusset includes first and second gusset panels inwardly V-folded and terminating at an end short of one of the front and back panel ends. A patch is adhered to one of the gusset panels and to one of the front and back panels, and is adhered (a) to the one gusset panel whereby the first and second gusset panels are both between the patch and the one of front and back panels, and (b) to the one of the front and back panels adjacent the gusset short end and adjacent the V-fold of the one gusset panel.

In one form of this aspect of the present invention, the patch is adhered by ultrasonic sealing to the one of the front and back panels adjacent the gusset short end and adjacent the V-fold of the one gusset panel.

In another form of this aspect of the present invention, the patch is thermo-adhered to the one of the front and back panels adjacent the gusset short end and adjacent the V-fold of the one gusset panel.

In still another form of this aspect of the present invention, a second gusset connects a part of the other side of the front and back panels on one of the opposite sides, where the second gusset includes third and fourth gusset panels inwardly V-folded and terminating at an end short of one of the front and back panel ends. A second patch is spaced from the first patch and adhered to one of the third and fourth gusset panels and to one of the front and back panels, wherein the second patch is adhered (a) to the one gusset panel whereby the third and fourth gusset panels are both between the second patch and the one of front and back panels, and (b) to the one of the front and back panels adjacent the gusset short end and adjacent the V-fold of the one gusset panel. In a further form, the first and second patches are aligned on opposite sides of the bag.

In still another aspect of the present invention, a method of forming a bag with at least one gusset on one side is provided, including (1) forming a bag blank having a front panel and a back panel connectable along opposite sides, (2) forming a gusset along one side of one of the front and back panels, the gusset comprising first and second gusset panels inwardly V-folded, (3) trimming off a fold connecting the front panel to the gusset and separating the front panel from the back panel and gusset to expose the front of the back panel and gusset, (4) removing a gusset portion at a selected position on the one side, (5) adhesively adhering a first patch to one of the gusset panels and the back panel, and (6) adhering the front panel along both of its sides to the gusset and back panel.

In a further form of this aspect of the invention, a second gusset is formed along the other side of the one of the front and back panels, and a second patch separate from the first patch is adhesively adhered to the back panel and second gusset.

In another form of this aspect of the invention, a zipper is formed between sides of at least one of the front and back panels where the gusset portions are removed.

DETAILED DESCRIPTION OF THE INVENTION

FIGS. 1-7 illustrate the process steps of making a bag with an interrupted gusset according to the present invention.

Figure 1:
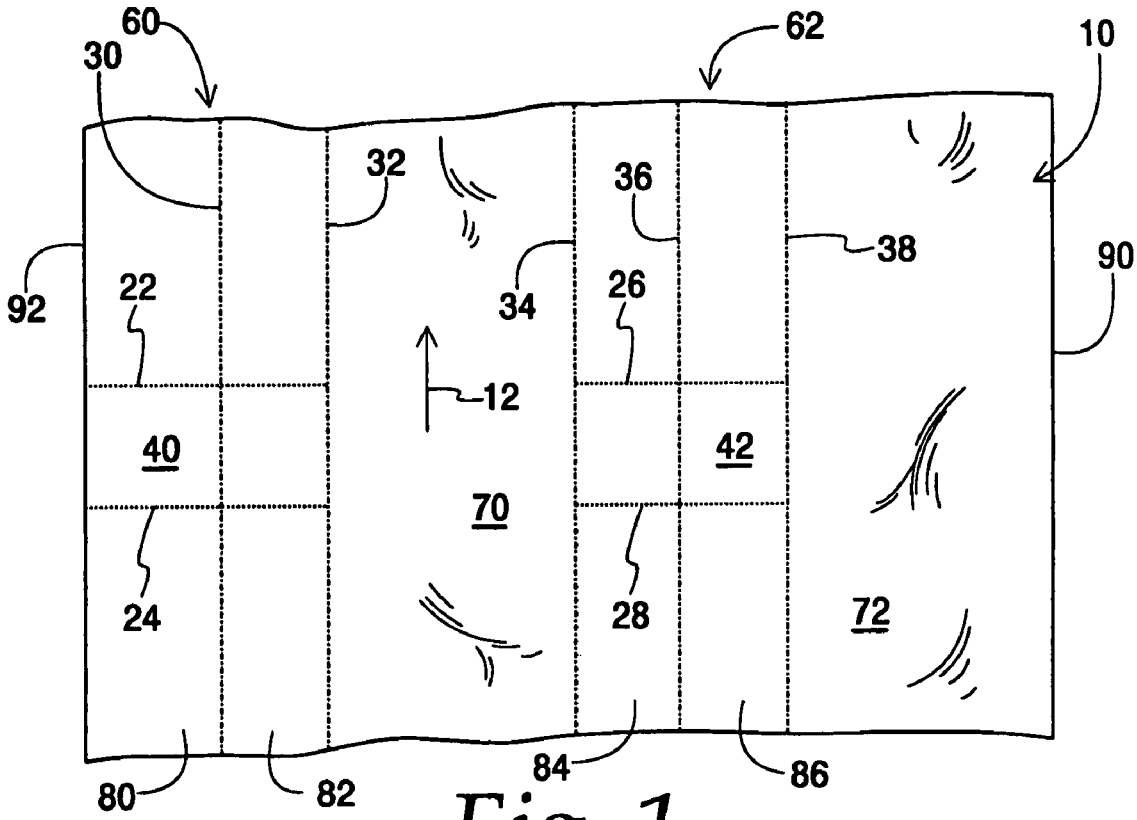
FIG. 1 is a plan view of a web of material following an initial step of the manufacturing process disclosed herein.

As illustrated in FIG. 1, a longitudinally extending flat web of material 10 (extending vertically) is provided from which a series of bags may be formed such as is generally known. The web of material 10 may be supplied in any suitable manner including, for example, a standard Hudson-Sharp Machine Co. model SDU 1600 unwind stand, which has an electrical surface driven and braked unwind with a compensator for perfect web tension control. Such web guide system may advantageously provide a suitably centered web at the exit to the unwind.

The material web 10 may advantageously include multiple layers in which one of the outer layers (i.e., the upwardly facing side in FIG. 1) has thermoadhesive properties.

Handling of the web 10 may be accomplished in any suitable manner, such as a dancer system with driven nip rollers (not shown) followed by a set of driven draw rolls operated to intermittently move the web 10 such as is known by those skilled in the art.

As the web 10 is advanced by, for example, the draw rolls, a number of actions are taken on the web 10 in the direction of arrow 12.

Figure 2:
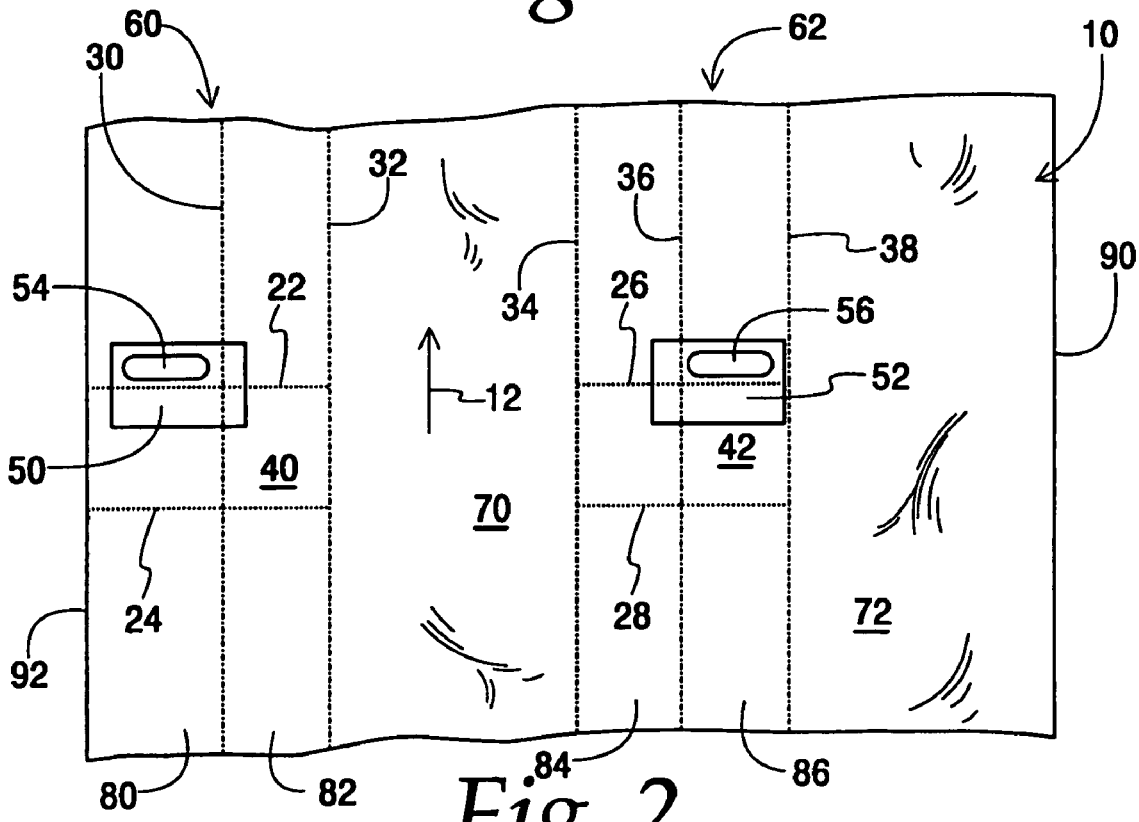
FIG. 2 is a plan view similar to FIG. 1, showing a further step of the manufacturing process with the patches applied to the web of material.

Four perforations are made in the web 10 along lines 22, 24, 26, 28, with the perforations extending laterally across the web 10 relative to five longitudinally extending folds 30, 32, 34, 36, 38 which will later be formed as described below. The location of the folds 30, 32, 34, 36, 38 are shown in FIGS. 1-2 for orientation purposes. Specifically, two perforations 22, 24 are longitudinally spaced apart and extend from one edge of the web 10 past fold 30 to fold 32. The other two perforations 26, 28 are similarly longitudinally spaced apart and extend from fold 34 past fold 36 to fold 38. Such perforations 22, 24, 26, 28 may be formed in a suitable manner, for example, between intermittent movements of the web 10, and define removable gusset portions 40, 42.

After the perforations 22, 24, 26, 28 are formed, two separate patches 50, 52 are applied as shown in FIG. 2, being adhered only at the areas 54, 56. The patches 50, 52 as illustrated are thermoadhesive on both sides, and the adhesion at areas 54, 56 may be accomplished via thermoadhesion. However, it should be understood that it would be within the scope of the present invention to adhere the patches via any suitable manner which will hold the patches 50, 52 in place, including not only thermoadhesion, but also glue spots, hot melt, self adhesion, ultrasonic sealing or even static electricity. The use of separate patches 50, 52 for each gusset is advantageous particularly where bags are produced on machines which make the bag in the longitudinal direction.

Figure 3:
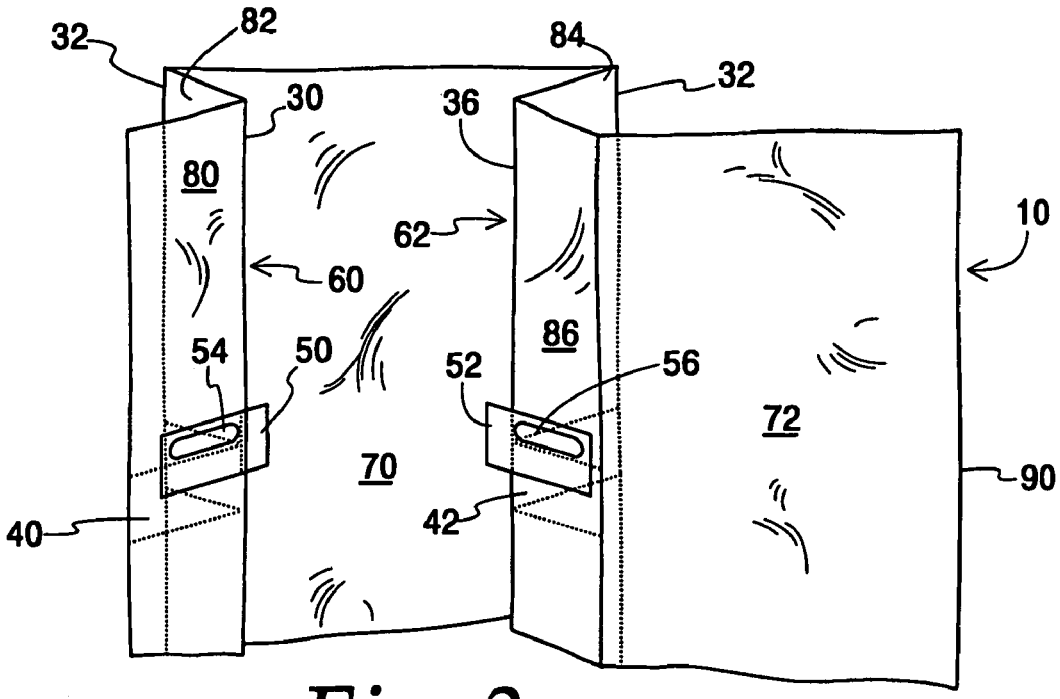
FIG. 3 is a perspective view of the web of material of FIG. 2 after an initial folding step.

The previously described folds 30, 32, 34, 36, 38 may then be suitably formed via any suitable folding technique, such as folding plates, folding triangles, and the like. When so folded as shown in FIG. 3, gussets 60, 62 are suitably formed along the material web 10 on opposite sides of a back or rear panel 70, including between one side of the back panel 70 and the front panel 72. (It should be appreciated that the designation front and back are used here for convenience of reference, and it does not matter within the scope of the present invention which of the panels 70, 72 is considered the front or the back.)

The first gusset 60 is on one side of the back panel 70, and includes a pair of gusset panels 80, 82 which are inwardly V-folded as shown in FIG. 3. The second gusset 62 is between the back and front panels 70, 72, and includes a pair of gusset panels 84, 86 which are also inwardly V-folded.

The folding is accomplished without folding the edges of the patches 50, 52. By being adhered only at the areas 54, 56 on gusset panels 80, 86, the patches 50, 52 will not fold relative to those panels 80, 86 with adjacent gusset panels 82, 84. Further, suitable fingers or the like could be provided during the folding process to prevent folding of the patches 50, 52 if necessary in that process.

Figure 4:
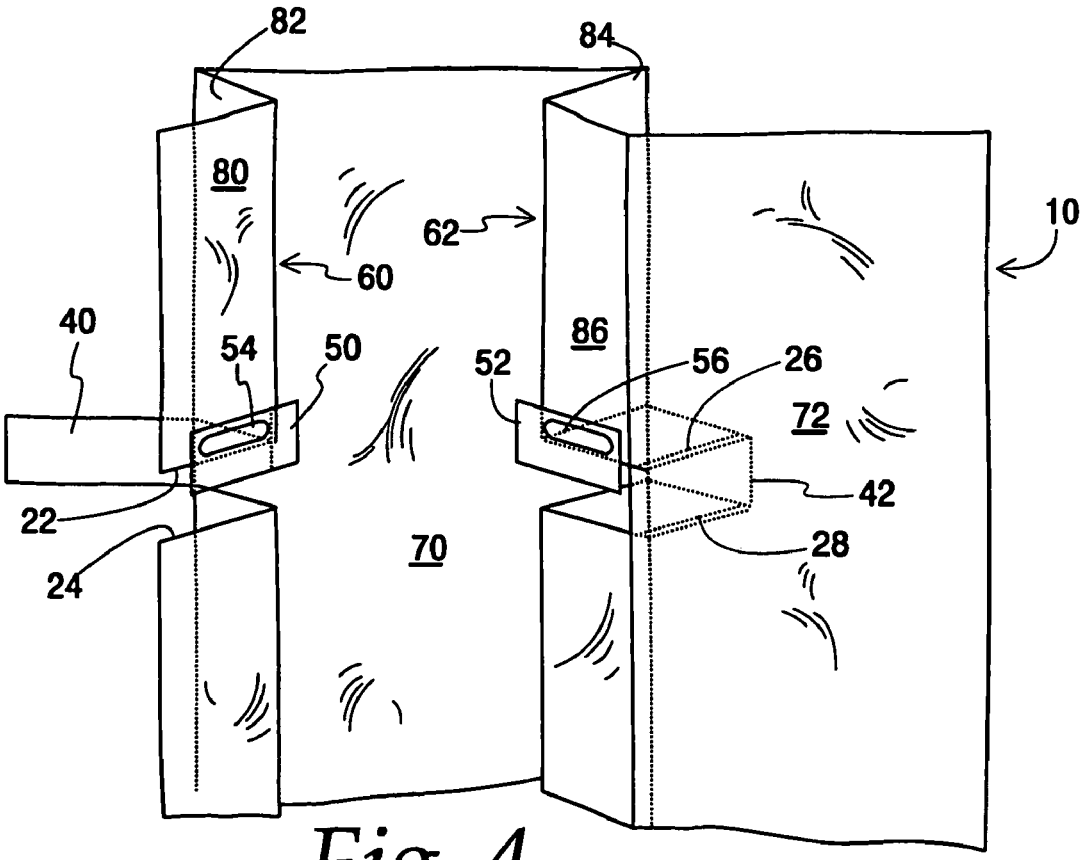
FIG. 4 is a perspective view of the web of material according to FIG. 3 after the gusset portions have been tucked out.

As illustrated in FIG. 4, the gusset portions 40, 42 are then removed by breaking the perforations 22, 24, 26, 28 and pulling the portions 40, 42 clear of the gussets 60, 62. This can be accomplished, for example, by use of a suitable mechanical gripper which grasps the gusset portions 40, 42 at the fold lines 30, 36 and moves past the edges of the folded web 10, causing the perforations 22, 24, 26, 28 to break as the portions 40, 42 tuck out.

Figure 5:
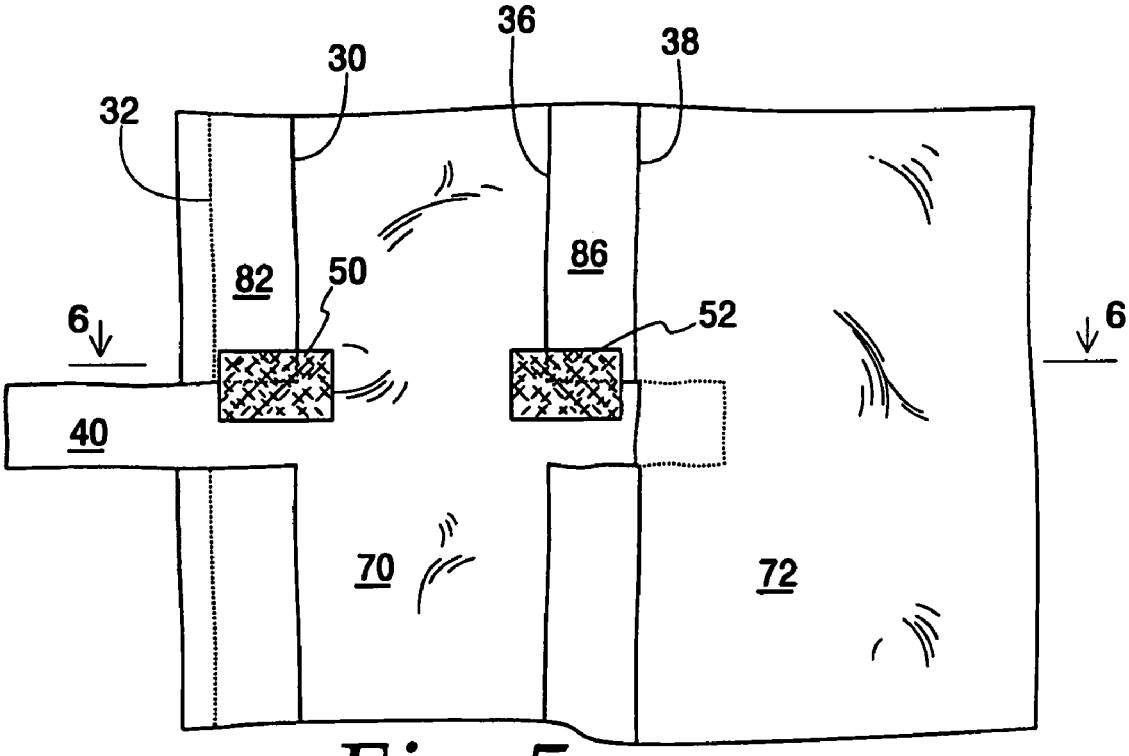
FIG. 5 is a plan view of the web of material according to FIG. 4 with the gussets folded flat and adhered in place by panels according to the present invention.
Figure 6:
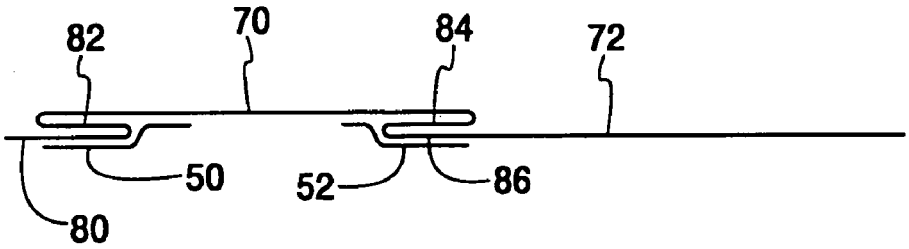
FIG. 6 is a top view of the web of FIG. 5.

Thereafter, as illustrated in FIG. 5, the patches 50, 52 are suitably secured to the web, with the portions of the patches 50, 52 projecting beyond the gusset panels 20, 86 to which they were previously adhered. With the gusset panels 80, 82 and 84,86 folded flat against the back panel 70, the patches 50, 52 are thermally pressed against the back panel 70. Due to the thermoadhesive surfaces, such heat and pressure essentially adheres the entire bottom surface of the patches 50, 52 to the gusset panels 80, 86 and the back panel 70, thereby securing each gusset 60, 62 flat against the back panel 70 as illustrated in FIG. 6. Thus it should be appreciated that the gussets 60, 62 are effectively eliminated at those locations, so that the opening size of the bag will be restricted.

Still other methods of adhering could be used, including ultrasonic sealing, hot melt, self adhesive patches, and the like, so long as the patches 50, 52 may be first applied in a manner which adheres only to the areas 54, 56, and the remainder of the patch surface later being adhered to the back panel 70 as described.

Figure 7:
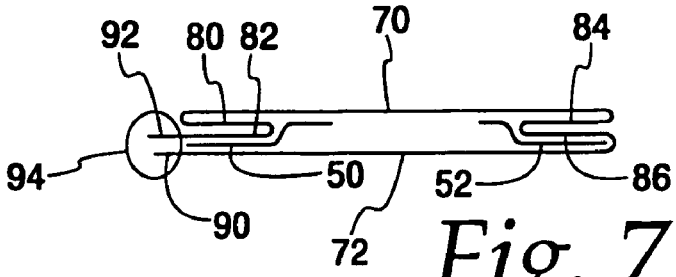
FIG. 7 is a top view similar to FIG. 6 with the front panel folded over to close the bag.

Finally, the front panel 72 is folded over as illustrated in FIG. 7 (which folding can be accomplished by any suitable folding machine). The edge 90 of the front panel 72 may then be secured to the edge 92 of the gusset panel 80 at the overlap 94 to close the lateral boundary of the bag.

It should be appreciated that the sequence of steps as described above may be varied somewhat in accordance with the present invention. For example, the front panel 72 may be folded over before the gusset portions 40, 42 are tucked out and the patches 50, 52 fully adhered to the back panel 70.

It should thus be appreciated that upon completion of the above steps the continuous web 10 will include a portion which is suitably secured to define an encircled longitudinal space. At this point, finishing operations such as are known to those skilled in the art may be accomplished, including operations like angle sealing, longitudinal sealing, cross sealing, handle cut outs and the like can also be carried out. Further, side trimming, of the gusset portions 40, 42, and of the closing overlap 94 can also be accomplished, with the removed materials discarded as scrap. A longitudinal end may also be cut and suitably sealed so as to separate the above described portion from the continuous web 10 and thereby define a separate bag.

Figure 8A:
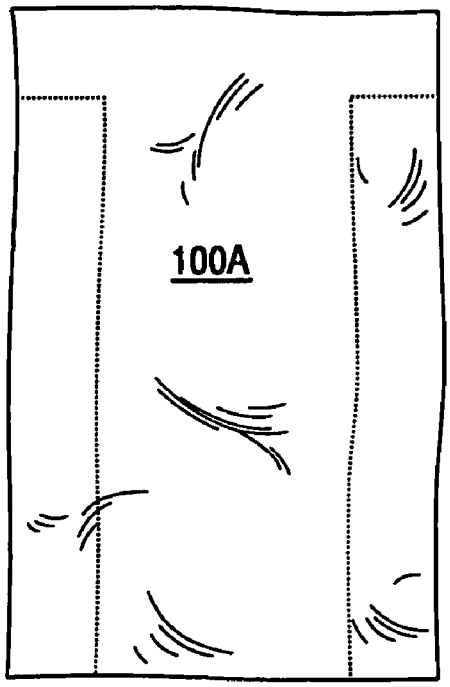
FIGS. 8A to 8D illustrate different bags having gussets variously interrupted in accordance with the present invention.
Figure 8B:
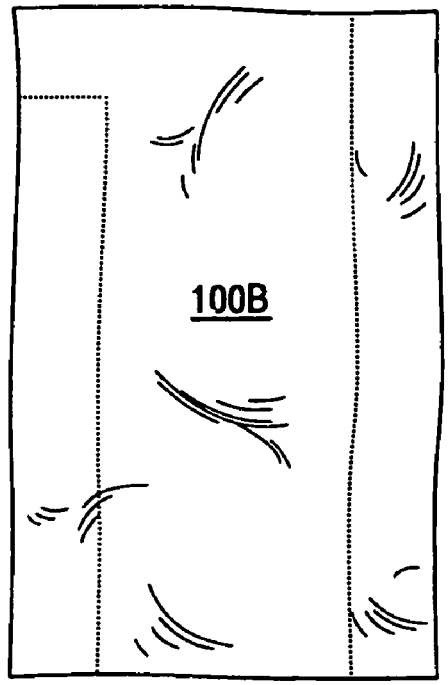
Figure 8C:
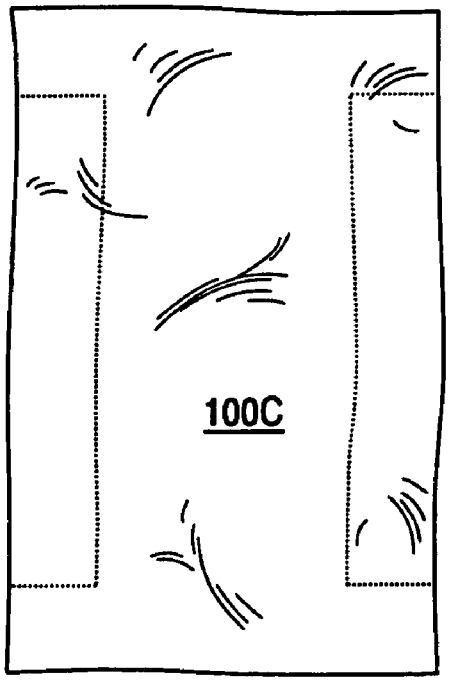
Figure 8D:
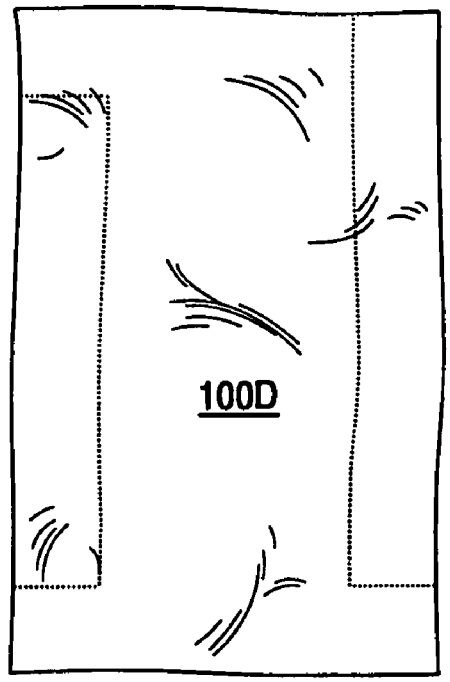

It should also be appreciated that the above method can be used to provide a variety of different bag designs, such as shown in FIGS. 8A-8D. FIG. 8A, for example, shows a bag design such as described above, with gussets extending along both sides, with the gussets being terminated on both sides near the top opening end of the bag 100A. FIG. 8B illustrates a bag 100B having only one end of one gusset interrupted, whereas FIG. 8C illustrates a bag 100C having four interruptions (at both ends of two gussets) and FIG. 8D illustrates a bag 100D having three interruptions.

FIGS. 9-15 illustrate the process steps of making a bag with an interrupted gusset according to another aspect of the present invention.

Figure 9:
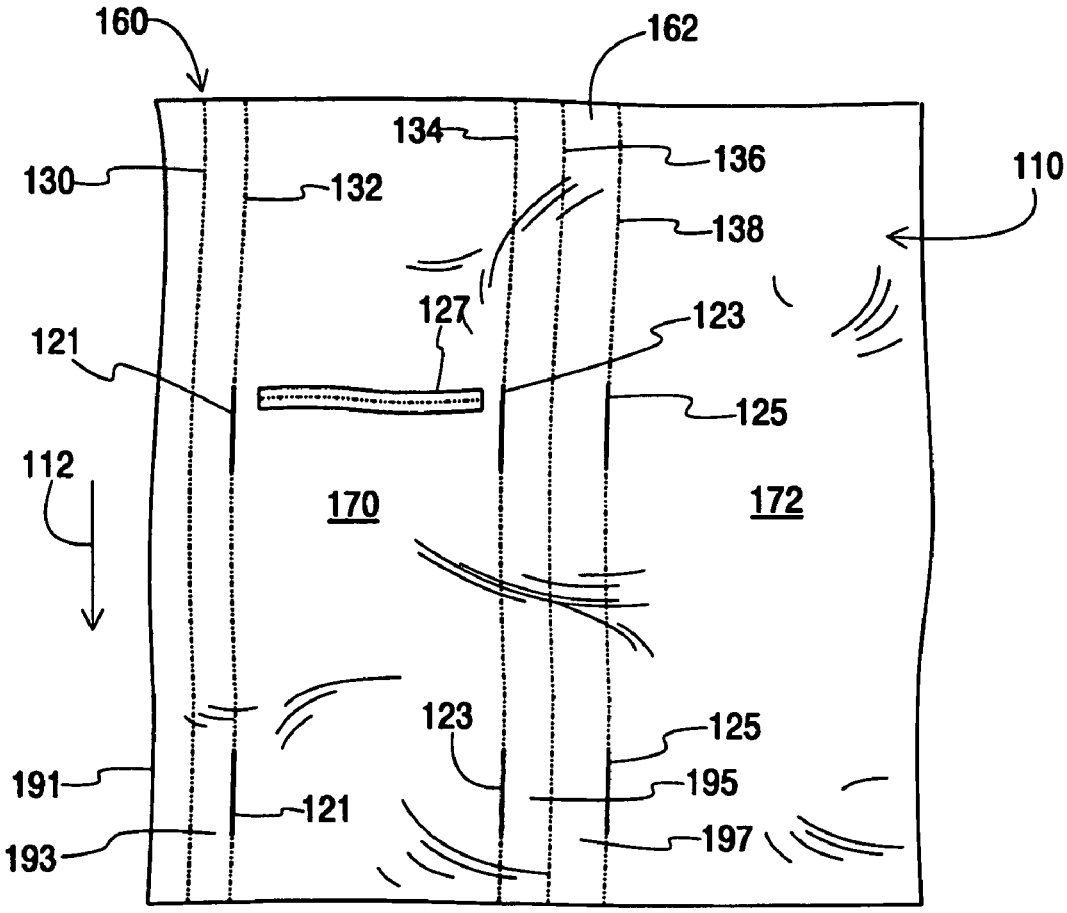
FIG. 9 is a plan view of a web of material following an initial step of an alternate manufacturing process disclosed herein.

As illustrated in FIG. 9, a longitudinally extending flat web of material 110 (extending vertically) is provided from which a series of bags may be formed such as is generally known. The web of material 110 may be supplied in any suitable manner including, for example, a standard Hudson-Sharp Machine Co. model SDU 1600 unwind stand, which as previously mentioned has an electrical surface driven and braked unwind with a compensator for perfect web tension control. Such web guide system may advantageously provide a suitably centered web at the exit to the unwind.

The material web 110 may advantageously include multiple layers in which one of the outer layers (i.e., the upwardly facing side in FIG. 9) may have thermoadhesive properties.

Handling of the web 110 may be accomplished in any suitable manner, such as a dancer system with driven nip rollers (not shown) followed by a set of driven draw rolls operated to intermittently move the web 110 such as is known by those skilled in the art.

As the web 110 is advanced by, for example, the draw rolls, a number of actions are taken on the web 110 in the direction of arrow 112.

Sets of three laterally spaced aligned slits 121, 123, 125 are cut at spaced locations along the web 110. A suitable zipper structure 127 may also be advantageously provided across the web 110 to provide a structure for closing the manufactured bag, which may include, for example, a slider element.

The web 110 includes five longitudinally extending folds 130, 132, 134, 136, 138 which will later be formed as described below, but are shown in FIG. 8 for orientation purposes. The slits 121, 123, 125 are located on three of those folds, with slit 121 cut along fold 132, slit 132 cut along fold 134 and slit 125 cut along fold 138. Such slits 121, 123, 125 may be formed in a suitable manner, for example, during intermittent movements of the web 110.

Figure 10:
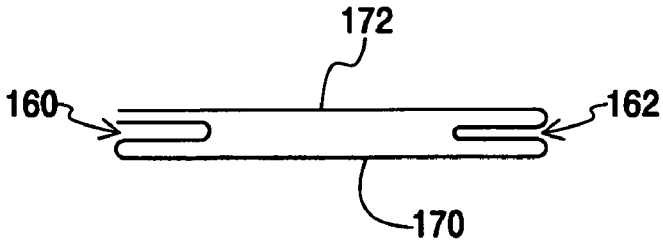
FIG. 10 is an end, cross-sectional view of the web of material of FIG. 9 after folding.

The folds 130, 132, 134, 136, 138 may then be suitably formed via any suitable folding technique, such as folding plates, folding triangles, and the like, as shown in FIG. 10, with gussets 160, 162 suitably formed along the material web 110 on opposite sides of a back or rear panel 170, including between one side of the back panel 170 and the front panel 172. (It should be appreciated that the designation front and back are used here for convenience of reference, and it does not matter within the scope of the present invention which of the panels 170, 172 is considered the front or the back.)

Figure 11:
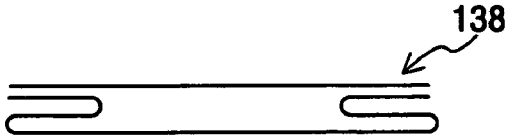
FIG. 11 is a view similar to FIG. 10, after one fold is trimmed according to the present invention.
Figure 12:
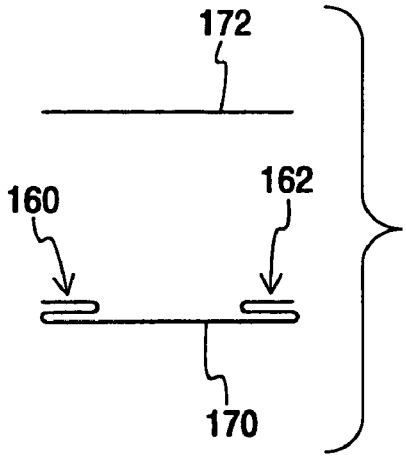
FIG. 12 is a view of the web according to FIG. 11, with the front panel separated from the back panel and gussets for further manufacturing steps.
Figure 13:
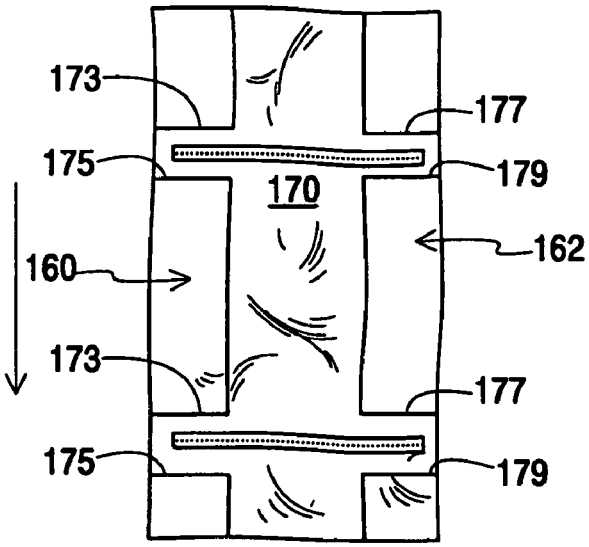
FIG. 13 is a plan view of the back panel and gussets of FIG. 12, with sections of the gussets removed according to the present invention.

Fold 138 is then trimmed as shown in FIG. 11 so as to effectively separate the front panel 172, which may be moved clear of the back panel 170 and gussets 160, 162 as shown in FIG. 12 so that access to the front of the back panel 170 may be had as shown in FIG. 13.

As also shown in FIG. 13, spaced sections of the gussets 160, 162 are also suitably removed by cutting laterally at opposite ends of the slits 121, 123 (as at reference numbers 173, 175, 177, 179). It should be understood that the cuts at 173, 175, 177, 179 could also be made earlier in the process (e.g., when the slits 121, 123, 125 are cut), making these cuts at this stage allow the trimmed material to be retained with the web 110 until they may be handled at this location in the manufacturing process.

Figure 14:
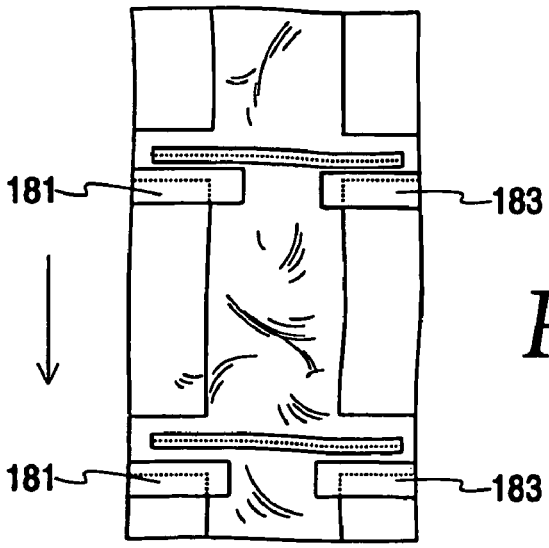
FIG. 14 is a plan view showing patches added to the structure of FIG. 13.

Two separate suitable patches 181, 183 are then applied as shown in FIG. 14 so as to seal each gusset length on one end. The patches 181, 183 may be thermoadhesive, and the adhesion to the gusset panels 191, 197 (trapping panels 193, 195) and to the back panel 170 may be accomplished via thermoadhesion. However, it should be understood that it would be within the scope of the present invention to adhere the patches via any suitable manner which will hold the patches 181, 183 in place, including not only thermoadhesion, but also glue spots, hot melt, self adhesion, ultrasonic sealing or even static electricity. The use of separate patches 181, 183 for each gusset is advantageous particularly where bags are produced on machines which make the bag in the longitudinal direction. Still other methods of adhering could be used, including ultrasonic sealing, hot melt, self adhesive patches, and the like.

Figure 15:
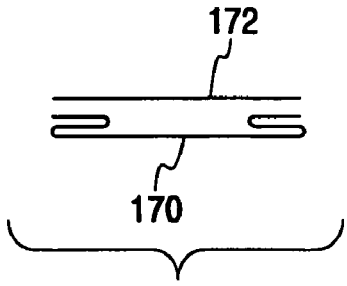
FIG. 15 is an end, cross-sectional view showing the front panel brought back to the back panel and gussets for reattaching according to the present invention.

Finally, the edge of the front panel 72 may then be secured to the edge of the gusset panels 191, 197 to close the lateral boundary of the bag (see FIG. 15. Separate bags may then be cut from the web 110 and also suitably sealed laterally (across the folded web) as is known in the art.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A method of forming a bag with at least one gusset on one side, comprising:

forming a bag blank having a front panel and a back panel connectable along opposite sides;

forming a gusset along one side of one of the front and back panels, said gusset comprising first and second gusset panels inwardly V-folded, said gusset panels having a removable gusset portion at a selected position on said side;

adhesively adhering one side of a patch to one of said gusset panels to a location adjacent said removable gusset portion, said patch having a second adhesive on portions extending beyond said one gusset panel location to said removable gusset portion and beyond said V-fold;

removing said removable gusset portion from said gusset;

adhering said second adhesive on said one side of said patch extending portions to facing portions of one of said front and back panel.

2. The method of claim 1, wherein said first and second patches are aligned on opposite sides of said bag.

3. The method of claim 1, wherein said step of adhering said second adhesive comprises ultrasonic sealing.

4. The method of claim 1, wherein said second adhesive is thermoadhesive on said one side of said patch, and said step of adhering said second adhesive comprises heating said patch while pressing said patch against said back panel.

5. The method of claim 4, further comprising forming a second gusset along the other side of one of the front and back panels, said second gusset comprising third and fourth gusset panels inwardly V-folded, said gusset panels having a removable second gusset portion at a selected position on said side;

adhesively adhering one side of a second patch to one of said third and fourth gusset panels to a location adjacent said removable second gusset portion, said second patch having thermoadhesive on said one side and portions extending beyond said third and fourth gusset panel location to said removable second gusset portion and beyond said V-fold;

removing said removable second gusset portion from said second gusset;

heating said second patch to adhere said one side of said second patch extending portions to facing portions of one of said front and back panel.

6. A method of forming a bag with at least one gusset on one side, comprising:

forming a bag blank having a front panel and a back panel connectable along opposite sides;

forming a gusset along one side of one of the front and back panels, said gusset comprising first and second gusset panels inwardly V-folded;

trimming off a fold connecting said front panel to said gusset and separating said front panel from said back panel and gusset to expose the front of said back panel and gusset;

removing a gusset portion at a selected position on said one side;

adhesively adhering a first patch to one of said gusset panels and said back panel; and adhering said front panel along both of its sides to said gusset and back panel.

7. The method of claim 6, further comprising the steps of forming a second gusset along the other side of said one of said front and back panels, and adhesively adhering a second patch separate from the first patch to the back panel and second gusset.

8. The method of claim 6, further comprising the step of forming a zipper between sides of at least one of said front and back panels where the gusset portions are removed.

* * * * *